US007882785B2

(12) United States Patent
Scheid

(10) Patent No.: US 7,882,785 B2
(45) Date of Patent: Feb. 8, 2011

(54) DEMOLITION CHARGE HAVING MULTI-PRIMED INITIATION SYSTEM

(75) Inventor: Eric Scheid, Bloomington, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 60 days.

(21) Appl. No.: 12/242,895

(22) Filed: Sep. 30, 2008

(65) Prior Publication Data

US 2009/0235837 A1 Sep. 24, 2009

Related U.S. Application Data

(63) Continuation-in-part of application No. 11/506,270, filed on Aug. 14, 2006, now Pat. No. 7,472,652.

(51) Int. Cl.
*F42B 3/00* (2006.01)

(52) U.S. Cl. ..... 102/331; 102/314

(58) Field of Classification Search ..... 102/331, 102/314, 320, 321, 322
See application file for complete search history.

(56) References Cited

U.S. PATENT DOCUMENTS

| | | | | |
|---|---|---|---|---|
| 2,697,399 | A | 12/1954 | McAdams | |
| 2,706,949 | A | 4/1955 | Kessenich | |
| 3,507,218 | A * | 4/1970 | Ballard et al. | 102/331 |
| 3,658,006 | A * | 4/1972 | Nistler et al. | 102/307 |
| 3,831,522 | A * | 8/1974 | Romney | 102/318 |
| 3,955,504 | A * | 5/1976 | Romney | 102/331 |
| 4,334,476 | A * | 6/1982 | Day et al. | 102/275.7 |
| 4,425,849 | A * | 1/1984 | Jorgenson | 102/275.12 |
| 4,957,027 | A | 9/1990 | Cherry | |
| 5,282,423 | A * | 2/1994 | Sikorski et al. | 102/431 |
| 5,932,835 | A * | 8/1999 | Woodall et al. | 102/403 |
| 6,227,095 | B1 * | 5/2001 | Woodall et al. | 89/1.13 |
| 7,000,545 | B2 * | 2/2006 | Sansolo | 102/331 |
| 7,337,703 | B2 * | 3/2008 | Sansolo | 89/1.14 |
| 7,472,652 | B1 * | 1/2009 | Scheid | 102/331 |

* cited by examiner

*Primary Examiner*—James S Bergin
(74) *Attorney, Agent, or Firm*—Christopher A. Monsey

(57) ABSTRACT

A demolition charge system has a multi-primed initiation system with a rigid container defining an internal chamber. An initiation tube is supported within the internal chamber and is configured to receive a demolition initiator.

10 Claims, 6 Drawing Sheets

DEMOLITION CHARGE HAVING MULTI-PRIMED INITIATION SYSTEM

CROSS-REFERENCE TO RELATED APPLICATION

This application is a continuation-in-part of U.S. patent application Ser. No. 11/506,270, filed Aug. 14, 2006, and issued as U.S. Pat. No. 7,472,652 on Jan. 6, 2009, the disclosure of which is expressly incorporated by reference herein.

STATEMENT OF GOVERNMENT INTEREST

The invention described herein was made in the performance of official duties by an employee of the Department of the Navy and may be manufactured, used, licensed by or for the United States Government for any governmental purpose without payment of any royalties thereon.

BACKGROUND OF THE INVENTION (1) Field of the Invention

The present invention relates to demolition charges and more particularly to demolition charges capable of being initiated by a variety of standard initiation systems or devices.

(2) Description of the Prior Art

Demolition packages containing explosives have long been used in the field to remove obstacles and accomplish a variety of other military purposes. Many of these demolition packages are hastily put together expedients; made under stressful conditions and, consequently, the packages may have sensitive components in the demolition train that detonate inadvertently or the packages simply may not have enough or the right kind of explosives to do what is needed. Consequently, the traditional bag-like "satchel charge" was developed to fill this need. The bag-like satchel charges are primarily canvas backpacks containing blocks of explosive linked by detonating cord. These charges are bulky (20 lbs) and are not easily primed or employed without some preparation by the user. The charges also do not have a multi-primed initiation system to assure reliable initiation. Additionally, because these charges can contain their own detonating cord and sensitive boosters, the charges are susceptible to accidental initiation. The traditional satchel charges can only be placed directly on or near a target and are not capable of being mounted by magnets, on a tripod or with other support apparatuses.

SUMMARY OF THE INVENTION

Accordingly, the present disclosure relates to a demolition charge capable of being reliably initiated by a variety of initiation systems or devices, and/or configurations thereof.

According to an illustrative embodiment of the present disclosure, a rigid container is provided having interconnected rigid thin end walls, side walls, a base wall and a lid. Illustratively, the lid continuously fits onto the end and side walls to cover and contain an internal chamber. Each of the ends walls has an opening longitudinally aligned with each other. An elongate hollow thin-walled plastic tube longitudinally extends through the internal chamber and couplers securely hold the tube in the container. At least one demolition initiator longitudinally would extend in the tube. In an alternate configuration and preferably used for smaller containers, two elongate hollow thin-walled tubes extending from corners of the container and integrating in the middle of the container may be used to contain the demolition initiators.

A main charge in the internal chamber is placed in close abutting intimate contact along the length of the tube(s) where the tube(s) extends through the chamber to assure demolition of the main charge. Illustratively, a continuous recessed strip portion having a continuous groove is provided to extend along a continuous rim of the end walls and the side walls.

In an illustrative embodiment, a continuous lip portion along the outer edge of the lid is shaped with an inwardly extending continuous rim. The lip portion and the inwardly extending continuous rim of the lid are sized to be fitted onto the strip portion and a continuous groove of the side and end walls with sufficient force to compress and override the continuous strip portion and fit the continuous rim into the continuous groove in a sealed interlocking engagement.

Threaded openings are illustratively supported by the end walls and have outer portions adapted to engage correspondingly shaped structure of a support structure to more advantageously locate the main charge with respect to a target. In an illustrative embodiment, elongate tubular receptacles are equidistantly spaced apart around the periphery of the internal chamber. Each of the elongate tubular receptacles has an elongate cavity extending between inner surfaces of the base and the lid to contain a magnet disposed in each cavity.

BRIEF DESCRIPTION OF THE DRAWINGS

Further objects and advantages of the present invention will become readily apparent upon reference to the following description of the preferred embodiments and to the accompanying drawings, wherein corresponding reference characters indicate corresponding parts in the drawings and wherein.

DESCRIPTION OF THE PREFERRED EMBODIMENT

Figure 1:
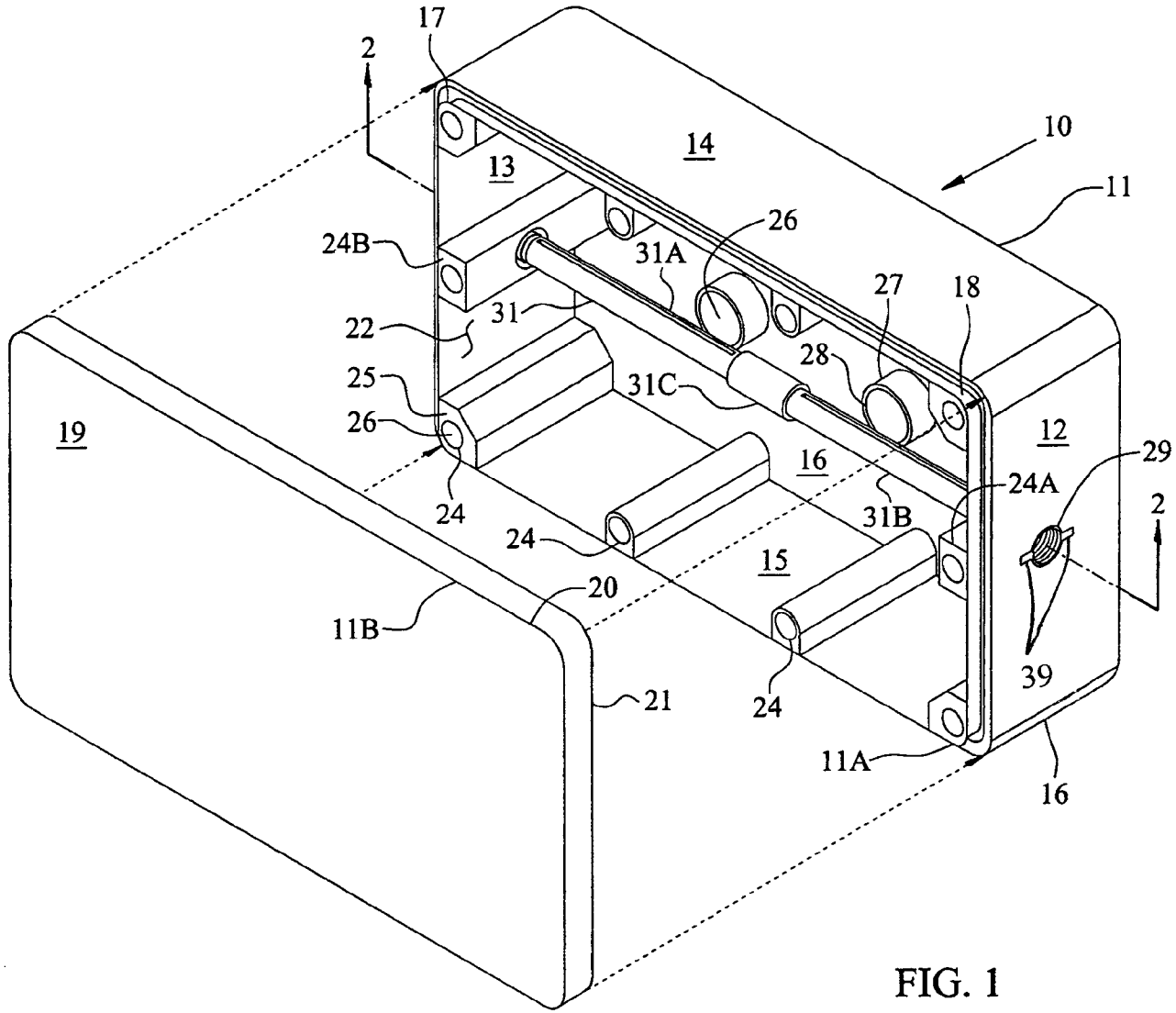
FIG. 1 depicts an isometric view of an illustrative rigid box-shaped charge container forming an internal chamber for containing a volume of explosives and having a lid of the container removed to depict a number of receptacles for magnets inside of and along the periphery of the explosive-filled chamber and a thin-walled initiation tube longitudinally extending through the chamber.
Figure 2:
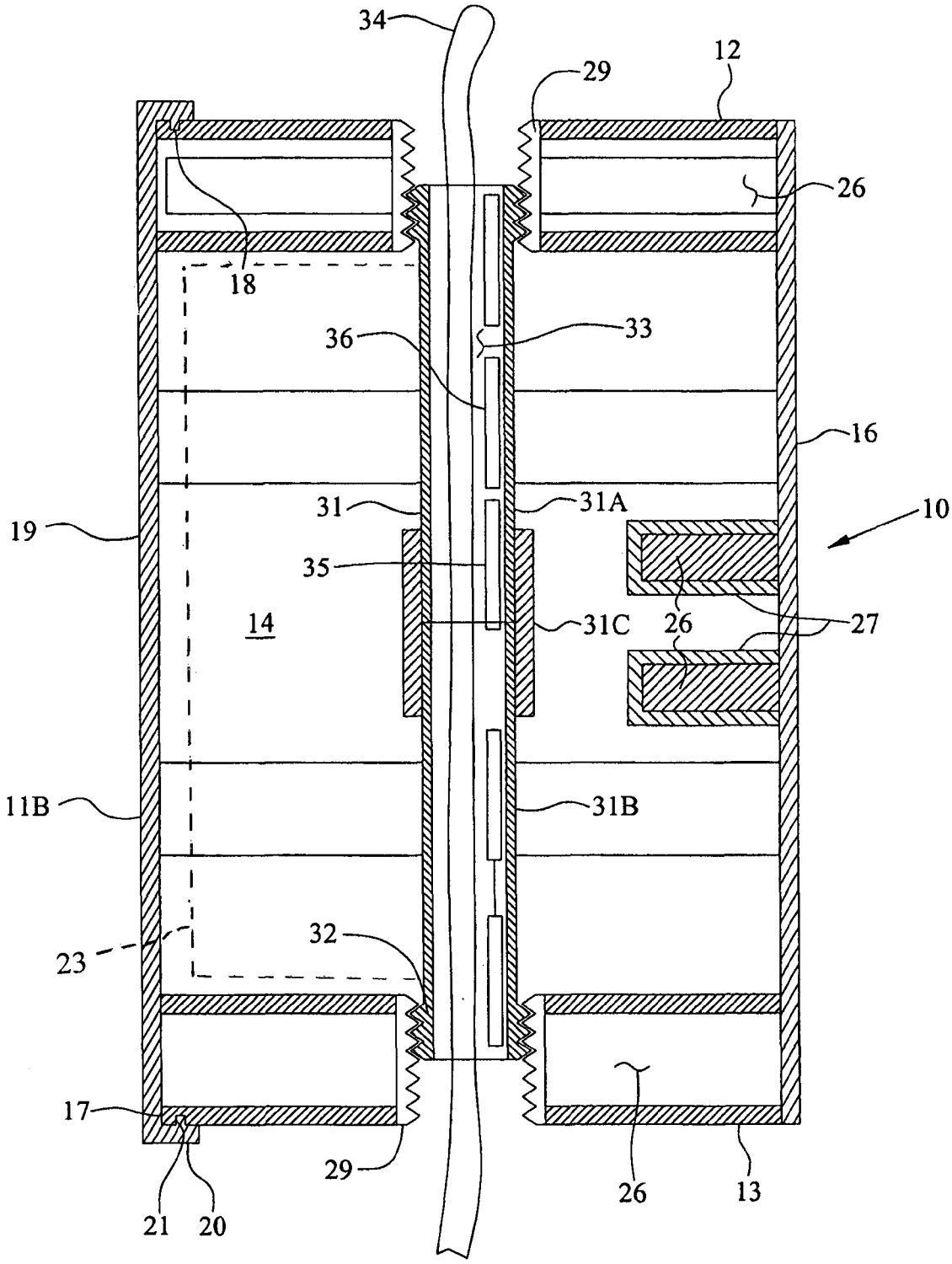
FIG. 2 depicts a cross-sectional view of the container and longitudinally extending thin-walled initiation tube, taken generally along reference lines 2-2 of FIG. 1 with the lid of the container and the container shown assembled, and with a detonating cord shown extending through opposing ends of the initiation tube.

Referring now to FIG. 1 and FIG. 2, an improved demolition charge system 10 of the present disclosure has a box-like container 11 made from a plastic material or other cost-effective material that creates a rigid structure suitable to house explosives, is relatively non-corrosive. Wood may be selected as well as most metals provided that they are properly treated to be sealed and resistant to the corrosive influences of the operating environment. The container 11 can be molded or extruded as an integral watertight rigid structure from the plastic material to have interconnected and relatively light-weight thin end walls 12 and 13, side walls 14 and 15, and base wall or base 16 of sufficient toughness and crush resistance to be serviceable for field operations. In one illustrative embodiment, the container 11 is formed of a thermoplastic, such as acrylonitrile butadiene styrene (ABS), wherein the walls 12, 13, 14, 15, and 16 are each approximately 0.150 inches thick for protecting explosives received within the container 11. Such a material was illustratively selected for its non-fragmentation, light weight, and low cost.

A continuous recessed strip portion 17 having a continuous groove 18 extends along a continuous rim 11A of the end walls 12 and 13 and the side walls 14 and 15.

A flat top wall, or lid 19 of the container 11 has a continuous lip portion 20 along an outer edge 11B that is shaped with an inwardly extending continuous rim 21. The lip portion 20 and the rim 21 are sized to be fitted onto the strip portion 17 and the continuous groove 18 with sufficient force to compress and override the strip portion 17 and to fit the continuous rim 21 into the groove 18 in a sealed and interlocking engagement. In other words, the rim 21 has sufficient resiliency and exerts sufficient inward bias to accommodate and ride-over the lip portion 20 and then snap into the groove 18 as the lid 19 is fitted onto the side walls 12, 13 and the end walls 14, 15. The container 11 having the lid 19 in place on the side walls 12, 13 and the-end walls 14, 15 and the base 16, covers and forms an internal chamber 22 that may contain, and is illustratively filled with an explosive main charge 23 (FIG. 2). Illustratively, the lid 19 is sealingly secured to the side walls 12, 13 and the end walls 14, 15 through conventional means, such as a glue adhesive By sealing the lid 19 to the walls 12, 13, 14, 15, users are not exposed to loose explosive materials, which are generally considered mild toxins and may cause a hazard if inadvertently detonated.

Since different explosives create different explosive effects, the constituency of main charge 23 can be suited to the task to be performed and the explosives available. Mixes of different explosives might be desirable or a smaller main charge 23 in the chamber 22 may be needed. In this case, the required amount of the selected explosives can be measured out and placed in the chamber 22, or if more is needed for a task, additional ones of the demolition charge system 10 can be stacked and simultaneously detonated. In either case, reliable demolition is assured because of the initiation of the present disclosure to be discussed further below.

In one illustrative embodiment, the chamber 22 of container 11 is configured to received approximately 10 pounds of explosive defining main charge 23. Illustratively, the main charge 23 may comprise a plastic explosive, such as composition C-4. Other explosives, including plastic bonded explosives (PBXs) may also be used, such as PAX-47, PBXN 109 or modifications thereof including a variety of fills. The main charge 23 may be received within a conductive container, such as a foil bag, particularly when a non-conductive container 11 is utilized in order to reduce undesirable electrostatic discharge (ESD).

The container 11 of the demolition charge system 10 has a number of elongate tubular receptacles 24 equi-distantly spaced apart around the periphery of the chamber 22. The receptacles 24 can be integrally formed with the end walls 12 and 13, the side walls 14 and 15, and the base 16. The receptacles 24 each have an elongate hollow cylindrical-shaped cavity 25 that extends between the inside surfaces of the base 16 and the lid when the lid 19 is secured on the recessed strip portion 17.

A magnet 26 is placed in each elongated cavity 25 shorter receptacles 27 having magnets 26 in their shorter cylindrical cavities 28 can be located on the base 16 along the centerline to further assure magnetic securing of the demolition charge system 10 on an iron-based surface. All of the magnets 26 can magnetically hold the demolition charge system 10 on and against a steel, iron, or other ferrous target. The magnets 26 also allow for the quick attachment of a fragmentation plate accessory (not shown) whether or not the magnets engage or not engage a target.

Optionally, one or more of the receptacles 24 and 27 can have the magnets 26 removed in order to reduce the overall weight of the demolition charge system 10. This option is more attractive when there is no need to anchor the demolition charge system 10 on ferrous targets.

The end walls 12 and 13 are illustratively provided with threaded fittings 29 having openings or apertures longitudinally aligned with each other and also extending through adjacent receptacles 24A and 24B. An elongate, hollow, thin-walled plastic initiation tube 31 extends through the chamber 22 approximate to the longitudinal centerline of the container 11 and through the center of the chamber 22 and where the main charge 23 would be positioned. In one illustrative embodiment, the initiation tube 31 is formed of a thermoplastic, such as acrylonitrile butadiene styrene (ABS).

The initiation tube 31 supports couplers, such as threaded ends engaging inner portions of the threaded fittings 29 to securely hold the tube 31 in the container 11. In an alternative embodiment shown in FIGS. 3 and 4, the coupler supported by each end of the tube 31' may include an enlarged head 34 having a pair of diametrically opposed keys 38. The keys 38 may be received within cooperating keyways 39 formed within walls 12 and 13 (FIG. 1).

The initiation tube 31 may be a single piece, but optionally the tube may have aligned portions 31A and 31B joined by a coupling sleeve 31C. The aligned portions 31A and 31B and coupling sleeve 31C may be useful to aid mounting of tube 31 in the container 11. The number of aligned portions 31A, 31B and coupling sleeves 31C forming the initiation tube 31 may vary based upon the dimensions of the container 11 and the required structural support required for the tube 31 to extend across the internal chamber 22. As further detailed herein in connection with FIGS. 5-8, in an alternate configuration and illustratively for use with smaller containers (five pounds of explosive main charge 23 vs. ten pounds of explosive main charge 23), two elongate hollow thin-walled initiation tubes may extend from the corners of the container and integrate in the middle of the container for containing demolition initiators. The configuration of the initiation tubes is similar to a cross when viewed from the top of the box and centralized within the volume of the container.

Irrespective of the exact configuration of the initiation tube 31, the tube 31 has a relatively large longitudinally extending internal duct 33 configured to receive a number of the demolition initiators for priming of the main charge. The demolition initiators can be individual ones of or can include combinations of: (1) a detonating cord 34 of fifty grains per foot size (i.e., fifty grams of explosive per foot of length), and/or (2) blasting caps 35 that may be connected to appropriate cap-initiating means such as, electrically conductive wires or a standard igniting fuse and/or (3) other standard military initiation devices 36 such as time-actuated, chemically-actuated, and/or remote radio signal-actuated detonators. These multi-primed combinations of demolition means increase the safety of operation by introducing redundancy and can create higher or more intense shock waves to further guarantee reliable demolition of the main charge.

Detonating cords 34 are known in the art as including a thin flexible tube receiving an explosive core. Detonating cords 34 provide flexibility, particularly during field installation within the initiation tubes 31. As shown in FIG. 2, the detonating cord 34 may extend longitudinally through the duct 33 and beyond opposing open ends of the tube 31, which are concentrically received within the openings 29 of opposing walls 12 and 13, in order to facilitate field assembly and the stringing together of multiple demolition charge systems 10.

The thin-walled initiation tube 31 can be sized (e.g. having a inner diameter of approximately 0.275 inches) to have one or more of the detonating cords 34, blasting caps 35, and the other standard detonators 36 quickly installed by the user to reliably initiate the main charge 23 in the chamber 22. The main charge 23 would be positioned in the chamber 22 in close-abutting and intimate contact along the length of the initiation tube 31 where the tube extends through the chamber 22 in order to assure demolition of the main charge 23. Reliable initiation is further enhanced because of the design of the initiation tube 31 extending through the main charge 23 in the chamber 22 and the use, if necessary, of a thin-walled cylinder booster charge. The booster charge would be wrapped around the hollow initiation tube 31.

Given the relatively weak explosive energy generated by typical detonating cords 34, the initiation tube 31 is thin-walled. More particularly, the portions 31A and 31B of tube 31 each include a tube wall 40 including at least a portion of which is thin enough to permit the explosive force from the detonating cord 34 to transmit sufficient energy to the main charge 23 to cause detonation thereof. In other words, the detonation of the detonating cord 34 has to provide enough shock through the plastic tube 31 and into to the explosive main charge 23 to cause the explosive main charge to react in various ways that cause it to detonate. Shock implies the existence of a shock front—a physical discontinuity in thermodynamic values. A shock front or wave is generally known as a type of propagating disturbance that carries energy and can propagate through a medium (solid, liquid or gas).

Figure 3:
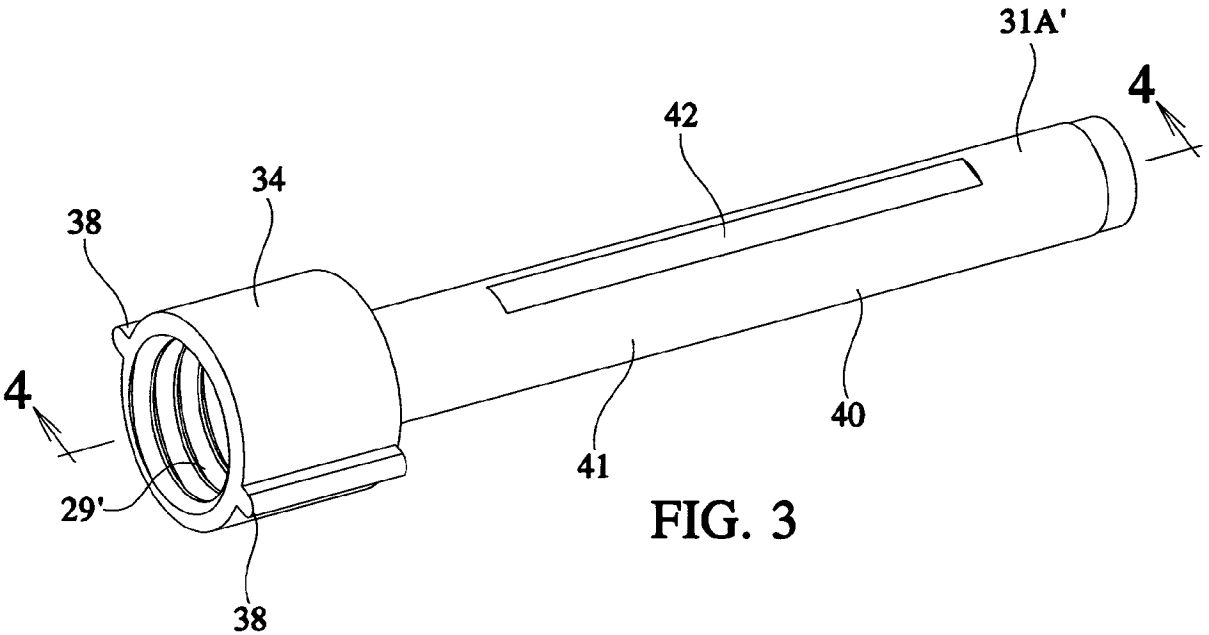
FIG. 3 depicts a perspective view of an illustrative thin-walled initiation tube for use within the charge container of FIG. 1.
Figure 4:
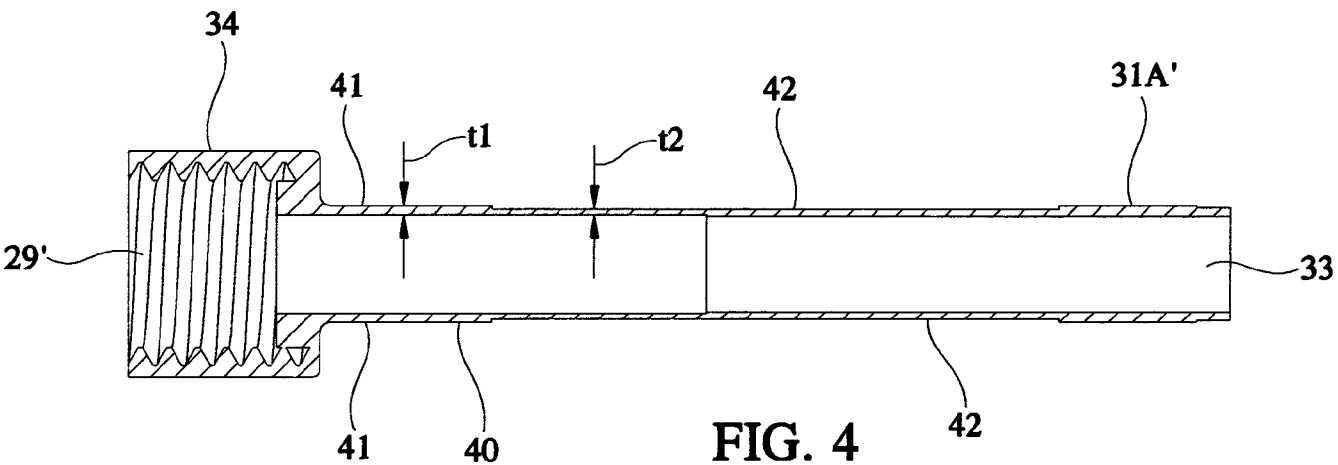
FIG. 4 depicts a cross-sectional view of the initiation tube of FIG. 3, taken generally along reference lines 4-4 of FIG. 3.

With reference to FIGS. 3 and 4, an illustrative embodiment portion 31A' of an initiation tube 31' is shown as including a side or tube wall 40 having a first portion 41 with a first wall thickness t1. A second portion of the tube wall 40, in the form of slots 42, has a second wall thickness t2. The slots 42 are diametrically opposed and extend axially along a majority of the length of the tube wall 40. The second wall thickness is illustratively less than 0.050 inches. While a thickness t2 of 0.030 inches provides improved detonation reliability, the illustrative embodiment slot 42 has a thickness t2 of about 0.020 inches (+/−0.003 inches tolerance) for event greater detonation reliability. In order to provide adequate structural support for the initiation tube 31', the first portion 41 illustratively has a wall thickness t1 of about 0.030 inches (+/−0.0003 inches tolerance). In summary, the dimensions and material of the tube wall 40 are illustratively designed based upon detonation properties of the detonating cord 34 and the main charge 23, wherein the tube wall 40 will permit the detonating cord 34 and the main charge 23 to function while being relatively insensitive to accidental detonation, reduce the risk of misfire or partial detonation due to failure to transmit sufficient energy or shock through the tube wall 40, obtain a uniform and predictable detonation of the main charge 23, and be stable enough to endure rough handling or impacts transmitted to the main charge 23 and to the detonating cord 34 placed within the tube 31 without accidental detonation or damage to the tube 31.

Use of a mounting tripod (not shown) or other mounting support apparatus for raising the demolition charge system 10 above the ground and specifically locating the system in close proximity next to a building or other above-ground target might be required to increase the effectiveness of the demolition charge system. The demolition charge system 10 of the present disclosure can be appropriately located for such applications since outer portions of the threaded fittings 29 that are not engaged by threaded ends 32 of the hollow initiation tube 31 can be used to receive a projection or correspondingly threaded mounting stud (not shown) of a mounting tripod or other support apparatus. In other words, the outer portions of the threaded fittings 29 are adapted to engage a correspondingly shaped structure of different support structures to more advantageously locate the main charge with respect to an intended target. Accordingly, the demolition charge system 10 of the disclosure can be used with a greater degree of effectiveness.

The demolition charge system 10 of the present disclosure is a needed improvement over the explosive expedients of the prior art. The amount and constituency of the main charge can be quickly tailored in the field if need be, or an appropriate number of demolition charge systems 10 can be quickly made beforehand for a demolition task. Since a particular size for the demolition charge system 10 can be "standardized" (at say about ten pounds, for example), a considerable inventory can be pre-made and personnel can be trained in their proper use. The container 11 can be made in a variety of different shapes instead of the box-like configuration referred to above so long as it encloses a chamber containing the correct amount of explosives.

The demolition charge system 10 can be primed with one or more of the detonating cords 34 so that the required number of demolition charge systems can be "strung" on the same line of the detonating cord 34 and initiated at the same time. Without the longitudinally extending thin-walled initiation tube 31 of each demolition charge system 10 containing the common "strung-through" detonating cord 34, each charge would otherwise need an individual detonator. Since detonators and handling detonators are known to be the most dangerous parts of a demolition system, the claimed demolition charge systems 10 having a common detonating cord 34 reduce or eliminate the need for multiple separate detonators and decrease the risks and hazards to users.

Since the demolition charge system 10 can be loaded with a variety of explosives, the main charge 23 can be tailored for the job and use the materials at hand. The selected main charge 23 may contain a booster that is less sensitive (safer) than previous charges, yet the main charge 23 is sensitive enough to be initiated via the detonating cord 34 coextending in the longitudinally extending initiation tube 31.

As a further safety feature of the demolition charge system 10 of the disclosure, the system need not be shipped or stored with the detonating cord 34 built in order to make the system safer and less likely to detonate accidentally. Instead, the detonating cord 34 can be quickly inserted through the duct 33 of the initiator tube 31 of each demolition charge systems 10 just prior to demolition in the field.

Threaded openings 29 create a pair of ports on opposite ends of demolition charge system 10. Accordingly, each demolition charge system 10 can be simultaneously mated to one or more detonators (detonating cord, blasting caps etc.) and onto a tripod or other mating projection on another support apparatus. The gives the user many options in the way the charge is used and makes using the charge easier than conventional designs. Optionally, cables could be strung through openings to provide for support and/or be used to slide or pull appropriate demolition initiators into the initiation tube 31 for immediate or later demolition.

FIGS. 5-8 show a further illustrative embodiment demolition charge system 110, providing similar advantages to those listed above with respect to demolition charge system 10, but in a smaller package. As noted above, the demolition charge system 10 is configured to receive a main charge of about 10 pounds of explosives, while the demolition charge system 110 is configured to receive a main charge of about 5 pounds of explosives.

The demolition charge system 110 illustratively includes a container 111 opposing side walls 112 and 113, and opposing side walls 114 and 115. The walls 112, 113, 114, and 115 are connected by corners 116A, 116B, 118A, and 118B and a base 120. As with container 11 detailed above, container 111 is formed of a thermoplastic, such as acrylonitrile butadiene styrene (ABS).

Figure 5:
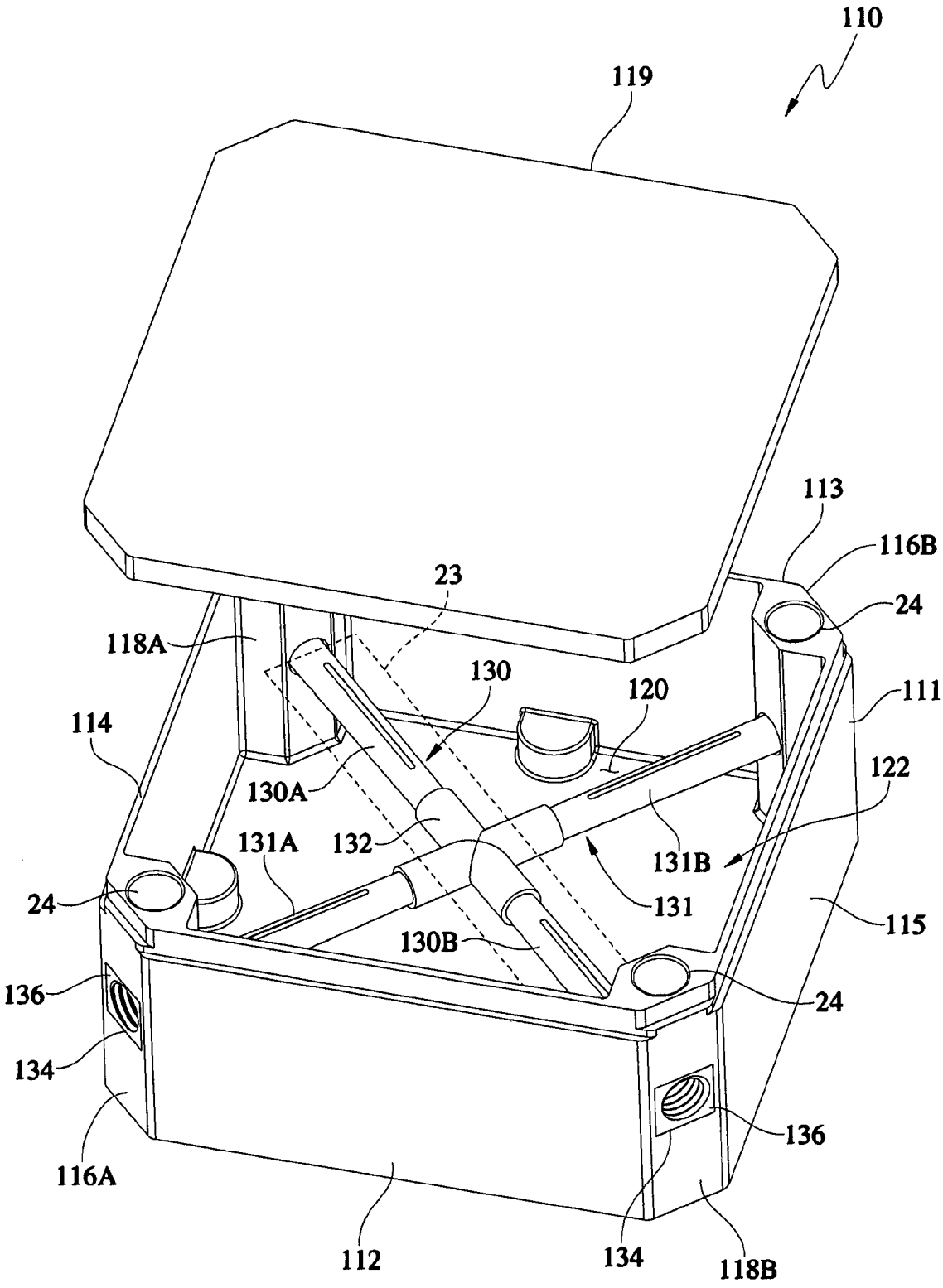
FIG. 5 depicts a perspective view of a further illustrative box-shaped charge container forming an internal chamber for containing a volume of explosives and having a lid of the container removed to depict perpendicularly disposed thin-walled initiation tubes extending through the internal chamber.

A flat top wall, or removable lid 119 of the container 11 cooperates with the walls 112, 113, 114, and 115. The container 111 having the lid 119 in place on the walls 112, 113, 114, and 115 and the base 120, covers and forms an internal chamber 122 that may contain, and preferable is filled with an explosive main charge 23 (FIG. 5).

The container 111 of the demolition charge system 110 has a number of elongate tubular receptacles 24 positioned proximate the corners 116A, 116B, 118A, and 118B of the chamber 122. As detailed above in connection with the demolition charge system 10, magnets 26 may be placed in receptacles 24. The magnets 26 are configured to magnetically hold the demolition charge system 110 on and against a steel, iron, or other ferrous target. The magnets 26 also allow for the quick attachment of a fragmentation plate accessory (not shown).

Figure 6:
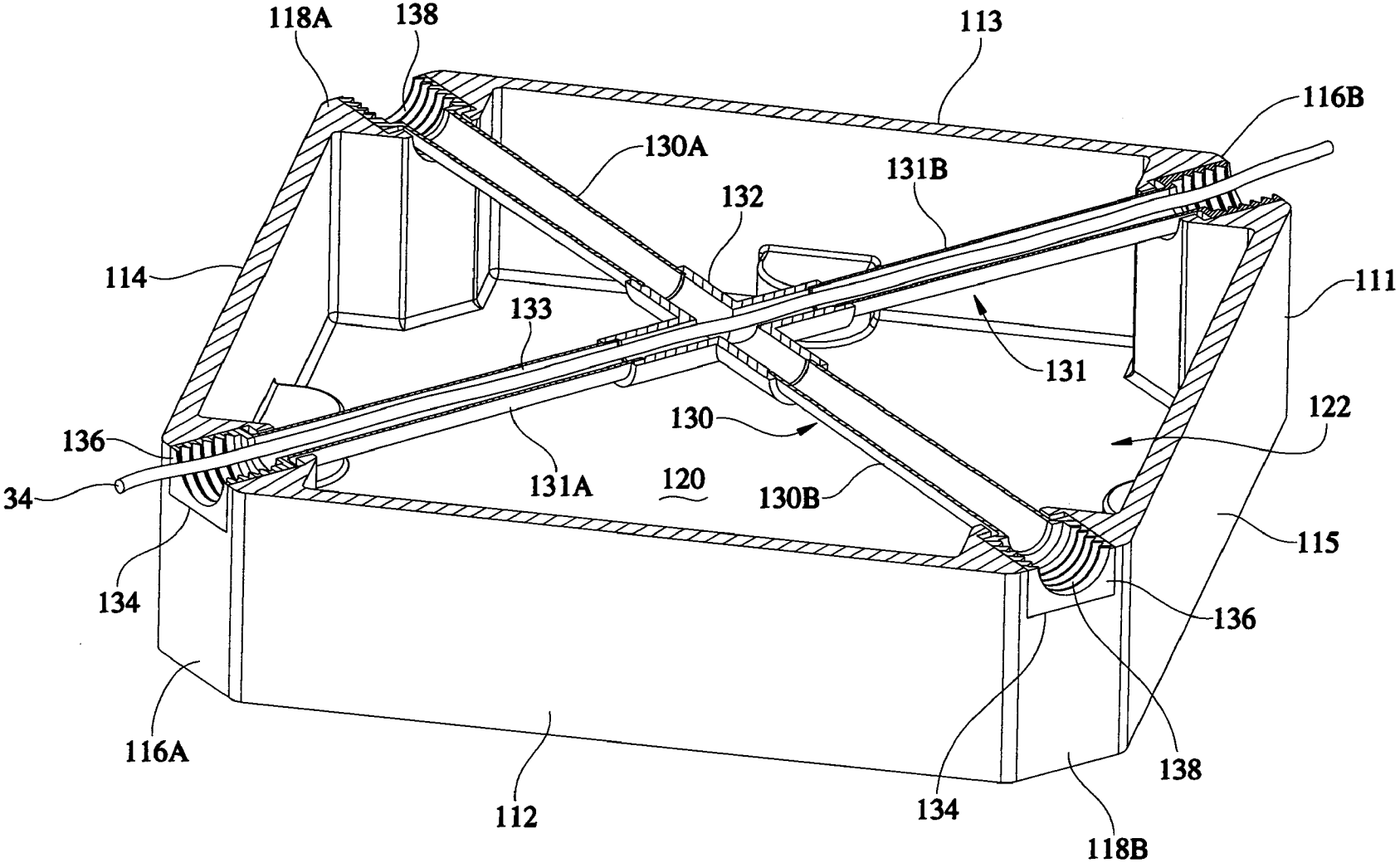
FIG. 6 depicts a perspective view similar to FIG. 5 in cross-section taken along a common center plane of the thin-walled initiation tubes, with a detonating cord shown extending through opposing ends of an initiation tube.

First and second initiation tubes 130 and 131 extend within the internal chamber 122 of container 111. As with initiation tube 31 detailed above, each initiation tube 130 and 131 illustratively comprises at least one elongated hollow tube configured to receive at least one demolition initiator, such as detonating cord 34. In one illustrative embodiment, the initiation tubes 130 and 131 may be formed of a thermoplastic, such as acrylonitrile butadiene styrene (ABS). While a pair of initiation tubes 130 and 131 are illustrated in FIGS. 5 and 6 for providing operational flexibility, typically only one of the initiation tubes 130, 131 will receive demolition initiator(s).

The first initiation tube 130 extends substantially perpendicular to the second initiation tube 131. The first initiation tube 130 is coupled to the second initiation tube 131 by a cross-shaped coupling member 132 supported proximate the center of the internal chamber 122. The initiation tubes 130 and 131 support couplers, such as enlarged heads in the form of blocks 136 supported by each opposing end of the tubes 130 and 131. The blocks 136 are illustratively received within cooperating openings 134 formed within corners 116A, 116B, 118A, and 118B to securely hold the tubes 130 and 131 in the container 111. Internal threads 138 are illustratively formed within each block 136 to couple, for example, to a mounting support apparatus. In alternative embodiments, other couplers may be used to secure tubes 130 and 131 within container 111. For example, the opposing ends of tubes 130 and 131 may include external threads engaging threaded fittings supported by the corners 116A, 116B, 118A, and 118B to securely hold the tubes 130 and 131 in the container 111.

Each initiation tube 130 and 131 is illustratively formed of aligned portions 130A, 130B and 131A, 131B, respectively, and joined together by the coupling member 132. The aligned portions 130A, 130B and 131A, 131B and coupling member 132 may be useful to aid mounting of tubes 130 and 131 in the container 111 and to provide structural support to the thin walled tubes 130 and 131. The number of aligned portions 130A, 130B and 131A, 131B the initiation tubes 130 and 131 may vary based upon the dimensions of the container 111 and the required structural support required for the tubes 130 and 131 to extend across the internal chamber 122.

Irrespective of the exact configuration of the initiation tubes 130 and 131, each tube 130 and 131 has a relatively large longitudinally extending internal duct 133 (e.g. having a inner diameter of approximately 0.275 inches) configured to receive a number of the demolition initiators for priming of the main charge. As detailed above, the demolition initiators can be individual ones of or can include combinations of detonating cords 34, blasting caps, and other standard detonators quickly installed by the user to reliably initiate the main charge 23 in the chamber 122. The main charge 23 is positioned in the chamber 122 is in close-abutting and intimate contact along the length of the respective initiation tube 130 and 131 where the tube 130, 131 extends through the chamber 122 in order to assure demolition of the main charge 23.

As shown in FIG. 6, the detonating cord 34 may extend longitudinally through the duct 133 of either or both initiation tubes 130, 131. The detonating cord 34 extends beyond opposing open ends of the respective tube 130, 131, which are concentrically received within the openings 134 of opposing corners 116A, 116B, 118A, 118B, in order to facilitate field assembly and the stringing together of multiple demolition charge systems 110.

Figure 7:
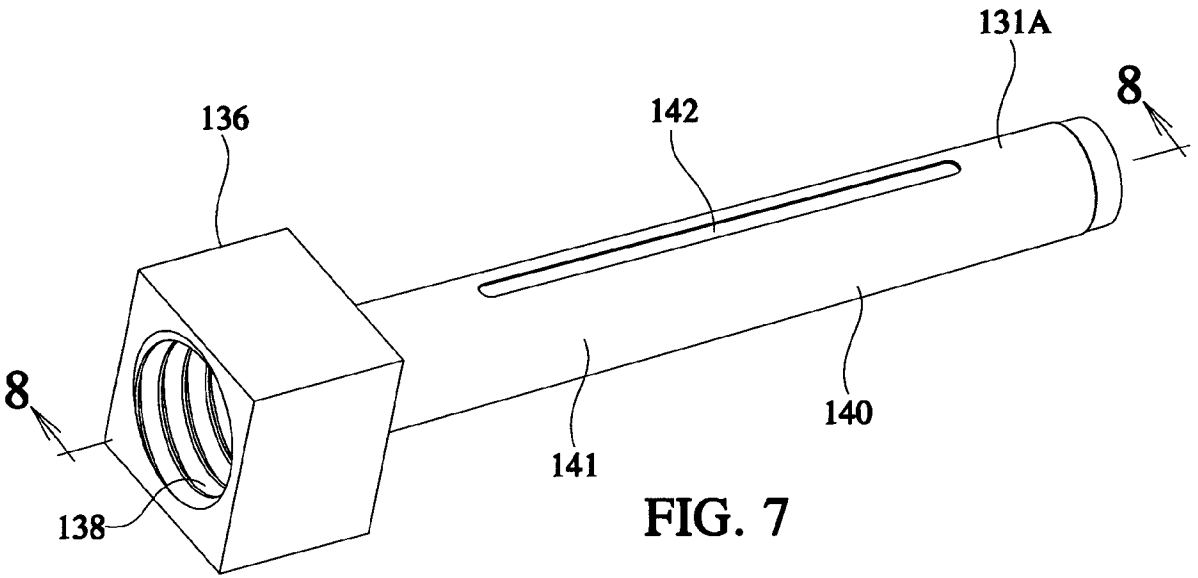
FIG. 7 depicts a perspective view of an illustrative thin-walled initiation tube for use within the charge container of FIG. 5.
Figure 8:
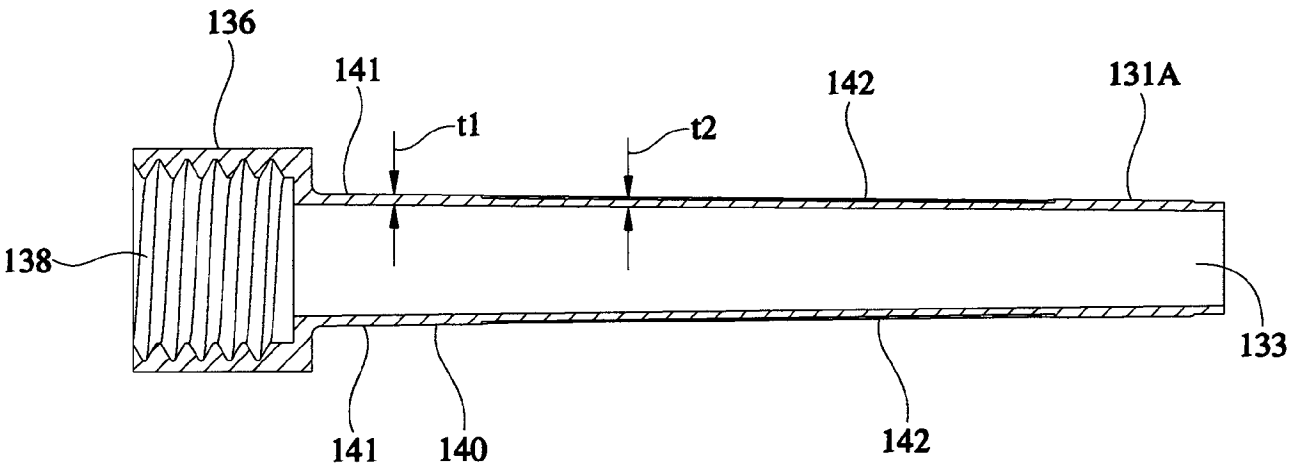
FIG. 8 depicts a cross-sectional view of the initiation tube of FIG. 5, taken generally along reference lines 8-8 of FIG. 7.

As with initiation tube 31, due to the relatively weak explosive energy of the detonating cord 34, the initiation tubes 130, 131 are thin-walled. In FIGS. 7 and 8, portion 131A of tube 131 is illustrated. It should be noted that portions 130A, 130B, and 131B are substantially identical to portion 131A. Portion 131A of tube 131 includes a tube wall 140 including at least a portion of which is thin enough to permit the explosive force from the detonating cord 34 to transmit sufficient energy to the main charge 23 to cause detonation thereof. More particularly, tube wall 140 includes a first portion 141 with a first wall thickness t1, and a second portion, in the form of slots 142, with a second wall thickness t2. The slots 142 are diametrically opposed and extending axially along a majority of the length of the tube wall 140. The second wall thickness t2 is illustratively less than 0.050 inches. While a thickness t2 of 0.030 inches provides improved detonation reliability, the illustrative embodiment slot 42 has a thickness t2 of about 0.020 inches (+/−0.003 inches tolerance) for event greater detonation reliability. In order to provide adequate structural support for the tube 131, the first portion 141 illustratively has a wall thickness t1 of about 0.030 inches (+/−0.0003 inches tolerance).

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A demolition charge system comprising:

a container defining an internal chamber comprising side portions, a base portion, and a lid portion, wherein said base couples to one edge of said sides and said lid couples to an opposing edge of said sides; and a first elongated hollow tube extending within said internal chamber, said first elongated hollow tube having a tube wall coupled with and extending between two opposing said side portions of said container, said tube wall having a first portion having a first wall thickness and a second portion having a second wall thickness, the first wall thickness being greater than the second wall thickness, said first portion is adapted to withstand a lateral pressure or impact substantially perpendicular to said first portion;

wherein said first elongated hollow tube is adapted to receive a detonating cord extending longitudinally within said first elongated tube, and said internal chamber of said container is adapted to receive a main charge such that said first elongated tube extends in proximity to said main charge for causing detonation of said main charge upon activation of said detonating cord, wherein said second wall thickness, width, and length being determined based on a minimum propagation of explosive force through said second portion from said detonating cord required to detonate said main charge, and material properties of said first elongated hollow tube which interfere with said explosive force;

wherein said container and said first elongated tube is adapted to be substantially consumed in a detonation of said main charge.

2. The demolition charge system of claim 1, wherein the second wall thickness is less than 0.050 inches.

3. The demolition charge system of claim 2, wherein the first wall thickness is about 0.030 inches and the second wall thickness is about 0.020 inches.

4. The demolition charge system of claim 1, wherein said detonating cord includes approximately 50 grains of explosive per foot of length.

5. The demolition charge system of claim 4, wherein said main charge comprises about 10 pounds of explosive.

6. The demolition charge system of claim 1, wherein said first elongated hollow tube is formed of thermoplastic.

7. The demolition charge system of claim 6, wherein said first elongated hollow tube is formed of acrylonitrile butadine styrene.

8. The demolition charge system of claim 1, comprising a second elongated hollow tube coupled to two opposing said side portions of said container, wherein said second said hollow tube is formed with said first and second portions as in said first elongated hollow tube.

9. The demolition charge system of claim 1, wherein said container is adapted to receive a liquid main charge which is cured into a solid such that said liquid charge does not lead out of said container during curing.

10. The demolition charge system of claim 1, further comprising a fragmentation layer.

* * * * *